US012234080B2

(12) United States Patent
Morrow

(10) Patent No.: US 12,234,080 B2
(45) Date of Patent: Feb. 25, 2025

(54) DEVICE THAT DISPENSES AND FACILITATES DONNING OF GLOVES ON HANDS

(71) Applicant: Cecily Alexandra Morrow, Newton, MA (US)

(72) Inventor: Cecily Alexandra Morrow, Newton, MA (US)

( * ) Notice: Subject to any disclaimer, the term of this patent is extended or adjusted under 35 U.S.C. 154(b) by 0 days.

(21) Appl. No.: 16/988,079

(22) Filed: Aug. 7, 2020

(65) Prior Publication Data

US 2021/0039875 A1 Feb. 11, 2021

Related U.S. Application Data

(60) Provisional application No. 62/884,076, filed on Aug. 7, 2019.

(51) Int. Cl.
*B65D 83/08* (2006.01)
*A41D 19/00* (2006.01)

(52) U.S. Cl.
CPC ..... *B65D 83/0811* (2013.01); *A41D 19/00* (2013.01)

(58) Field of Classification Search
CPC .... A41D 19/00; B65D 83/0811; A61B 42/40; A61B 42/50; A47G 25/92; A47G 25/904; A47G 25/90
USPC ..... 221/1
See application file for complete search history.

(56) References Cited

U.S. PATENT DOCUMENTS 361,852 A * 4/1887 Alderman ..... A47F 1/128 211/54.1
1,996,377 A * 4/1935 Hinchen ..... A61B 42/50 223/111
4,150,807 A * 4/1979 Manso ..... A47B 23/06 248/452
4,889,266 A * 12/1989 Wight ..... A61B 42/40 223/111
5,878,909 A * 3/1999 Rogow ..... A61B 42/50 221/45
6,375,034 B1 * 4/2002 Corbett ..... A61B 42/50 221/45
7,635,067 B1 * 12/2009 Flynn ..... A61B 42/40 223/111
7,712,642 B2 * 5/2010 Gaines ..... A47G 25/904 223/111
7,805,772 B2 * 10/2010 Williams ..... A61B 42/40 2/111

(Continued)

FOREIGN PATENT DOCUMENTS

GB 2449251 A * 11/2008 ..... A61B 42/40
WO WO-03020109 A2 * 3/2003 ..... A61B 42/40
WO WO-2008139192 A1 * 11/2008 ..... A47G 25/904

*Primary Examiner* — Rakesh Kumar
(74) *Attorney, Agent, or Firm* — Onello & Mello, LLP

(57) ABSTRACT

The invention is a compact glove dispenser and gloving device that sanitarily dispenses and dons disposable gloves on hands and is designed for ease of use, low complexity, and low cost. Individual gloves are packaged with glove palm and fingers folded with the open cuff facing the flat surface of the packaging, held open and in place by a frame made of thin material. Multiple glove packets are positioned in cartridges in a storage area, oriented for mechanical transporting to dedicated left and right gloving areas. Once in the gloving area, the glove cuff is held open, presented to the user who pushes hands through the packaging, donning the glove in a single motion.

15 Claims, 9 Drawing Sheets

(56) References Cited

U.S. PATENT DOCUMENTS

| | | | | |
|---|---|---|---|---|
| 8,146,776 | B2 * | 4/2012 | Balkin | A47K 17/003 221/26 |
| 8,550,314 | B2 * | 10/2013 | Kelly | A61B 42/40 223/111 |
| 8,678,252 | B2 * | 3/2014 | Kelly | A61B 42/40 223/111 |
| 10,098,699 | B1 * | 10/2018 | Buck | A61B 42/40 |
| 10,799,310 | B2 * | 10/2020 | Gaines | A61B 42/40 |
| 10,912,405 | B1 * | 2/2021 | McCarthy | A47G 25/904 |
| 2004/0149788 | A1 * | 8/2004 | Sato | A61B 42/40 223/111 |
| 2005/0087573 | A1 * | 4/2005 | Unsworth | A47G 25/904 223/112 |
| 2006/0010563 | A1 * | 1/2006 | Michel | A61B 42/50 2/159 |
| 2006/0144878 | A1 * | 7/2006 | Williams | A47G 25/904 223/111 |
| 2007/0170213 | A1 * | 7/2007 | Gaines | A61B 42/50 223/111 |
| 2010/0147909 | A1 * | 6/2010 | Kelly | A61B 42/50 223/111 |
| 2011/0108587 | A1 * | 5/2011 | Williams | A61B 42/40 223/111 |
| 2011/0186589 | A1 * | 8/2011 | Lee | A61B 42/50 221/36 |
| 2013/0104284 | A1 * | 5/2013 | Kantrowitz | A61B 42/00 2/161.7 |

* cited by examiner

DEVICE THAT DISPENSES AND FACILITATES DONNING OF GLOVES ON HANDS

CROSS-REFERENCE TO RELATED APPLICATIONS

Provisional Patent application No. 62/884,076 filed on Aug. 7, 2019.

FIELD OF THE INVENTION

This invention is a compact mechanical device that enables dispensing of gloves and facilitates donning of gloves on hands. Applications include, but are not limited to, dispensing and donning of examination gloves for use in medical, dental, laboratory, food handling, manufacturing industries, and for consumers.

BACKGROUND OF THE INVENTION

Workers across many fields use protective gloves of all kinds every day. Gloved hands are employed by medical and dental workers, laboratory workers, food handlers, factory workers, and consumers to prevent the spread of bacterial, viral, and fungal infections to people, to prevent contamination of food and other products, and to improve worker safety and product outcome. Despite current gloving efforts, infections, spread of disease, and contaminated food and other products continue to cause people missed work, severe illness, increased visits to medical offices, extensive medical treatments, hospitalizations, and, in some cases, death. Infections, the spread of disease, and contaminated products can lead to unnecessary costs across medical, dental, laboratory, food, and manufacturing industries for business owners, workers and consumers; many of these problems could be largely avoided with the use of a mechanical hand gloving device.

A common method of housing and dispensing gloves in these situations is via cardboard boxes that sit on a counter or in a wall bracket. The cardboard box has a tear-out opening, allowing air-borne contaminants to enter and settle on exposed gloves. To access gloves, workers reach into the cardboard box with a possibly unwashed, contaminated, and unprotected hand and pull out gloves that are often stuck to excess gloves which fall into the user's hands or onto the dirty floor.

Excess gloves that come out into the user's hands or fall onto the floor are further contaminated with bacteria, etc., yet are many times stuffed back into the box. Excess gloves that are thrown away after falling onto the floor are wasted product. The cardboard box itself can become soiled, leaching contaminants onto gloves inside. In some cases, open boxes themselves fall onto the floor overturned, spilling gloves or contaminating exposed gloves.

A hospital nurse who works a 12 hour shift, in charge of 6 patients, might contact a patient 4 times during that shift, meaning she should put on gloves approximately 24 times during that one shift. If excess gloves come out of the box or drop onto the floor half the time on that one shift with that one nurse, and she has to stuff them back in or bend down, pick them up, and throw them away, that is a lot of time and energy spent bending down that she does not need to do, and soiling or wasting of gloves that do not need to be thrown away if stored and dispensed efficiently. Multiply that level of contamination and waste by all the nurses, nurse technicians, and doctors for all patients on all shifts in all hospitals just in North America and that is a significant amount. In work-station situations, the current method of glove storage, dispensing, and putting gloves on by hand is cumbersome, time-wasting, product wasting, and lacks sufficient protection for workers, patients, food handling, or product protection.

The current, recommended method for donning exam gloves requires a degree of dexterity, focus, and attention to detail. The first glove is taken out of the cardboard box by using fingers to pinch the exterior surface near a glove's wrist cuff and removing from the box. The user dons this first glove. The second glove is then similarly removed from the box with the fingers of the remaining hand, again only touching the glove's wrist cuff. In order to avoid the gloved hand touching the skin of the forearm, the external surface of the second glove is turned onto the curved fingers of the gloved hand. These fingers then pull the second glove onto the second hand.

Busy, tired workers may find it difficult to follow the recommended donning procedure accurately, and may even be unmotivated to put gloves on or change gloves when necessary due to the inconvenient and bothersome process. For example, tired nurses may not have the energy or desire to change gloves between handling different patients. Food handlers are often rushed and touch non-sanitary surfaces and objects with their gloved hands, then continue to handle food items. Workers will be motivated and want to use this invention because it offers an easy-access, fun, quick way to put on gloves. Consumers will appreciate the convenience of having disposable gloves easily accessible and ready to be donned effectively in their homes and vehicles.

This compact, simple invention provides a quick and easy way to dispense and don gloves in a sanitary manner. The ease of use encourages the appropriate donning and frequent change of gloves. The novel manner of preparing and orienting the glove within the packaging makes for a relatively simple mechanism for donning. The manner in which the invention facilitates donning of the gloves ensures that sanitary conditions are met. In addition to any disposable gloves or examination gloves, surgical gloves may be dispensed and donned with this device for its convenience and ease of use.

OBJECTS OF THE INVENTION

A principal object of this invention is to dispense and facilitate donning of gloves in a convenient, reliably sanitary fashion for workers, patients, and consumers, to achieve the desired level of protection for medical and dental workers and their patients from infection, as well as for protecting lab workers, factory workers, food handlers, and consumers from contaminants and from contaminating the food or materials that they are handling. Any person using disposable gloves can benefit from this invention.

Another object of this invention is to eliminate waste by the dispenser keeping and holding excess gloves inside the dispenser, not letting them fall onto the floor or becoming contaminated through being touched by unwashed hands.

A further object of this invention is to save worker time by the dispenser quickly presenting and holding one or two gloves ready in gloving position, and providing mechanical and visual guides to facilitate the user donning each glove in a quick and accurate manner.

Another object of this invention is to save worker energy because the dispenser holds the untouched, sanitary gloves inside the dispenser. The worker is not forced to take extra steps to manually select and separate gloves from a clump of gloves, or pick up excess gloves that have fallen onto the floor that require disposal.

Another object of the invention is to provide support and motivation for workers and consumers to don gloves and change gloves when required by providing a convenient, quick, easy, even fun, way to do so.

BRIEF SUMMARY OF THE INVENTION

In summation, the invention provides a quick and easy way to dispense and don gloves in a sanitary manner. The ease of use provided by the invention encourages the appropriate use, donning, and changing of gloves.

The invention includes a compact housing, approximately, but not limited to, the size of a wall-mounted paper towel dispenser, that encloses a storage area for individually packaged gloves and mechanisms to dispense individual gloves into a gloving area where gloves are held in position for users' hands to be gloved. An internal or external disposal area holds the residual packaging material that remains after gloving is complete.

The invention includes individually packaged gloves where each packet presents one prepared glove where the cuff opening of the glove is presented toward the flat side of the packet to facilitate the entry of the hand, and each glove finger has been manipulated for ease of insertion of the user's fingers. The position and orientation of the prepared glove is determined such that when the packet is presented to the user for donning, the fingers of the user's hand are lined up with the corresponding openings for the fingers of the prepared glove. The position and orientation of the prepared glove within the package is maintained through the design of the packet, process of packaging, or use of temporary adhesives, or any combination of the above. The packaging material and design is such that when the user's fingers apply pressure against the flat surface of the packet, in line with the openings for the fingers of the prepared glove, the packaging material easily tears open at the pressure point, allowing the fingers of the user's hand to enter their corresponding glove fingers.

Each individual glove packet is designed, through choice of materials or use of rings, tabs, flanges, or similar components, to facilitate the handling by a mechanism that transports an individual packet from the storage area to the gloving area. The glove packet is designed, through use of a frame, choice of package material or other suitable method, to facilitate a mechanically stable presentation of the glove packet to the user such that the packet is held in place while withstanding the pressure from the user's fingers inserting into the glove's fingers.

The invention includes a method by which the device presents the packaged glove ready for donning, the user pushes his hand, fingers lined up with corresponding glove fingers, toward the presented glove, inserting fingers into the glove opening, with each finger of the user's hand entering the corresponding finger of the prepared glove. Once a glove is donned and the user's hand has pulled away from the housing and packaging, the mechanism which held the packaged glove releases the now empty packet for disposal and is made ready to engage the next glove packet for donning.

The invention reduces the spread for diseases by avoiding the problem of workers contaminating gloves while donning in the current, manual way. Users' time and energy are saved with this invention because it eliminates having to struggle to put on gloves by hand and to deal with excess gloves that come out of the box when users reach in to grab one pair of gloves. The invention reduces the spread of diseases by avoiding the problem of contaminated but unused gloves being put back into storage and used by a subsequent worker. Another problem that is solved with this invention is that the waste of unused, yet contaminated, gloves is eliminated because the invention holds individually packaged gloves. As well, users who are required yet reluctant to put on gloves repeatedly throughout their workday will be relieved to use a quick, easy, even fun, mechanism to glove their hands.

In these drawings, representations of the invention are illustrated by way of example, it being expressly understood that the description and drawings are only for the purpose of illustration, and are not intended as a definition of the limits of the invention.

DETAILED DESCRIPTION OF THE INVENTION

Figure 1:
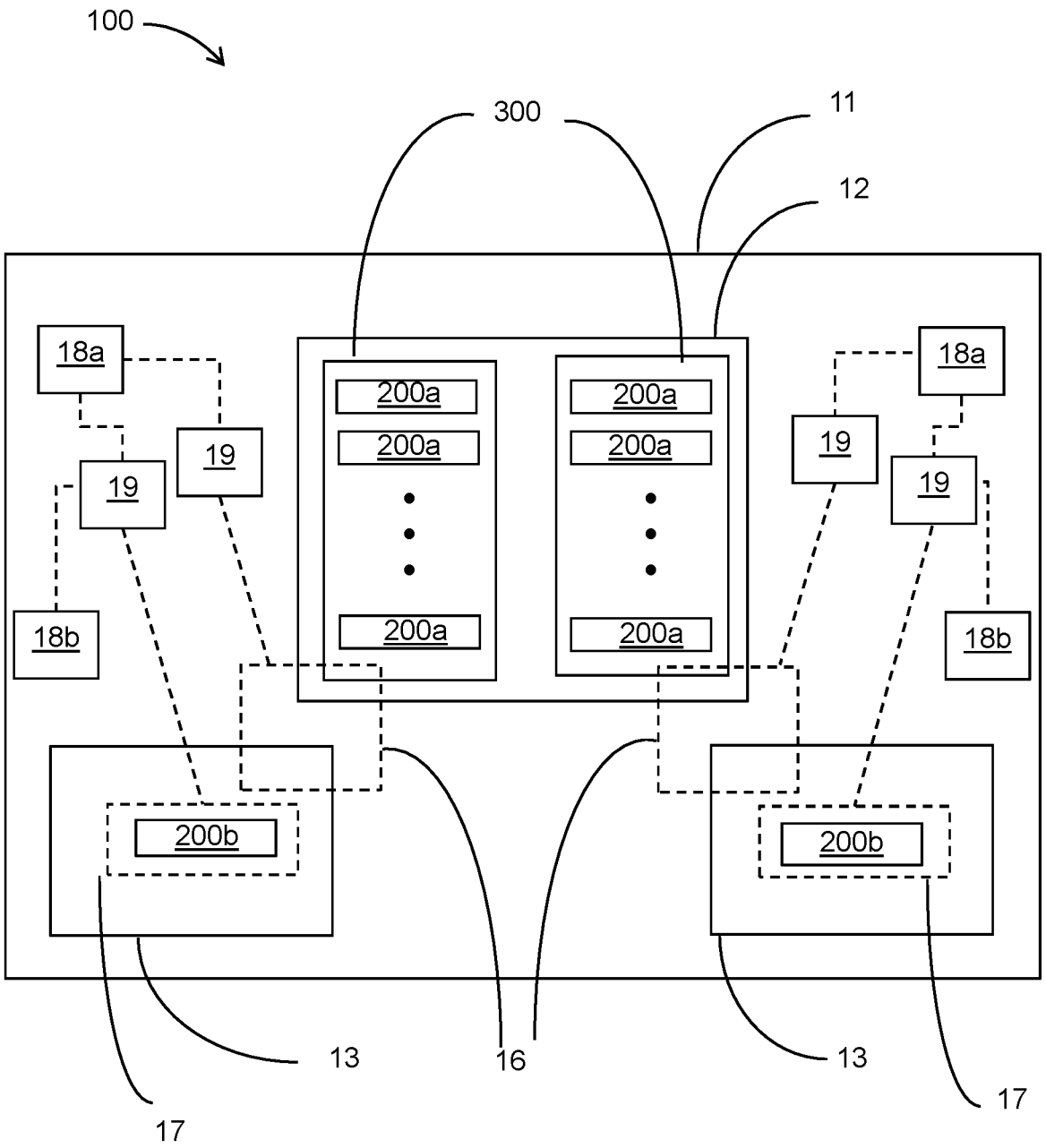
FIG. 1 shows a schematic representation of the present invention, according to one or more examples of the present disclosure.

The following relates to the general form of the present invention. As shown schematically in FIG. 1, the device (100) consists of a housing (11) that encloses a storage area (12), and one or two gloving areas (13). Within the storage area (12) are cartridges (300), holding multiple packaged glove packets (200*a*). A first mechanism (16) transports a single glove packet (200*a*) from the storage area (12) to the gloving area (13). Glove packets that have been thereby transported are labeled 200*b*. A second mechanism (17) presents and holds a single glove packet (200*b*) in the gloving area (13) for donning by the user. A linkage between the first and second mechanisms may be utilized to cause the actuation of the second mechanism to immediately follow the actuation of the first mechanism. In the preferred embodiment, a sensor (18*a*) detects the presence of the user's hand and activates an actuator (19), which may be an electric motor or pneumatic device, to operate said first mechanism (16) and second mechanism (17). In another embodiment, sensor 18*a* may activate separate actuators (19) to operate said first mechanism followed by said second mechanism. Another sensor (18*b*) detects the presence of the user's fully gloved hand and causes the second mechanism to release the remaining packaging material.

Figure 2:
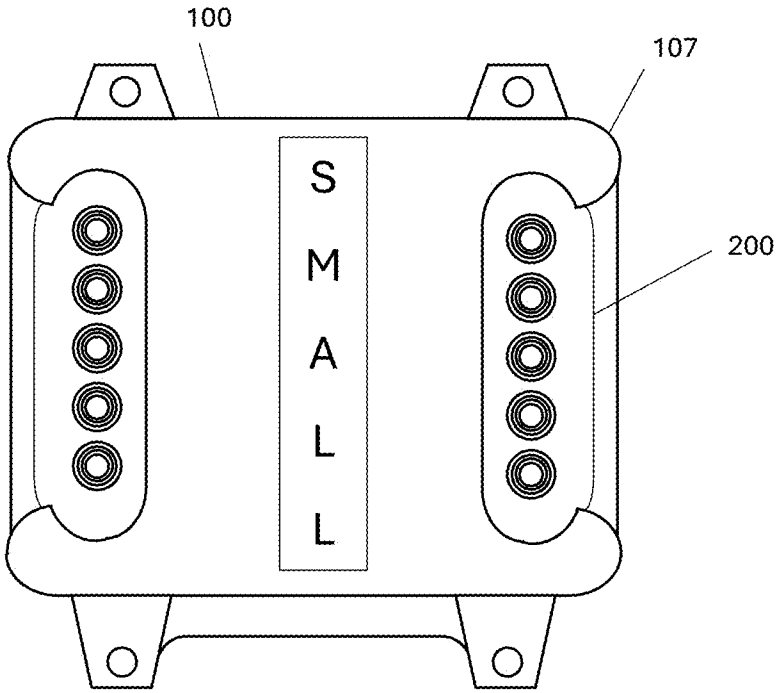
FIG. 2 shows a front view of a glove dispenser (100) with glove packets (200) already loaded into gloving position. Large dots visible on the glove packet exterior are finger guides to visually orient the user's fingers into the correct donning position.
Figure 3:
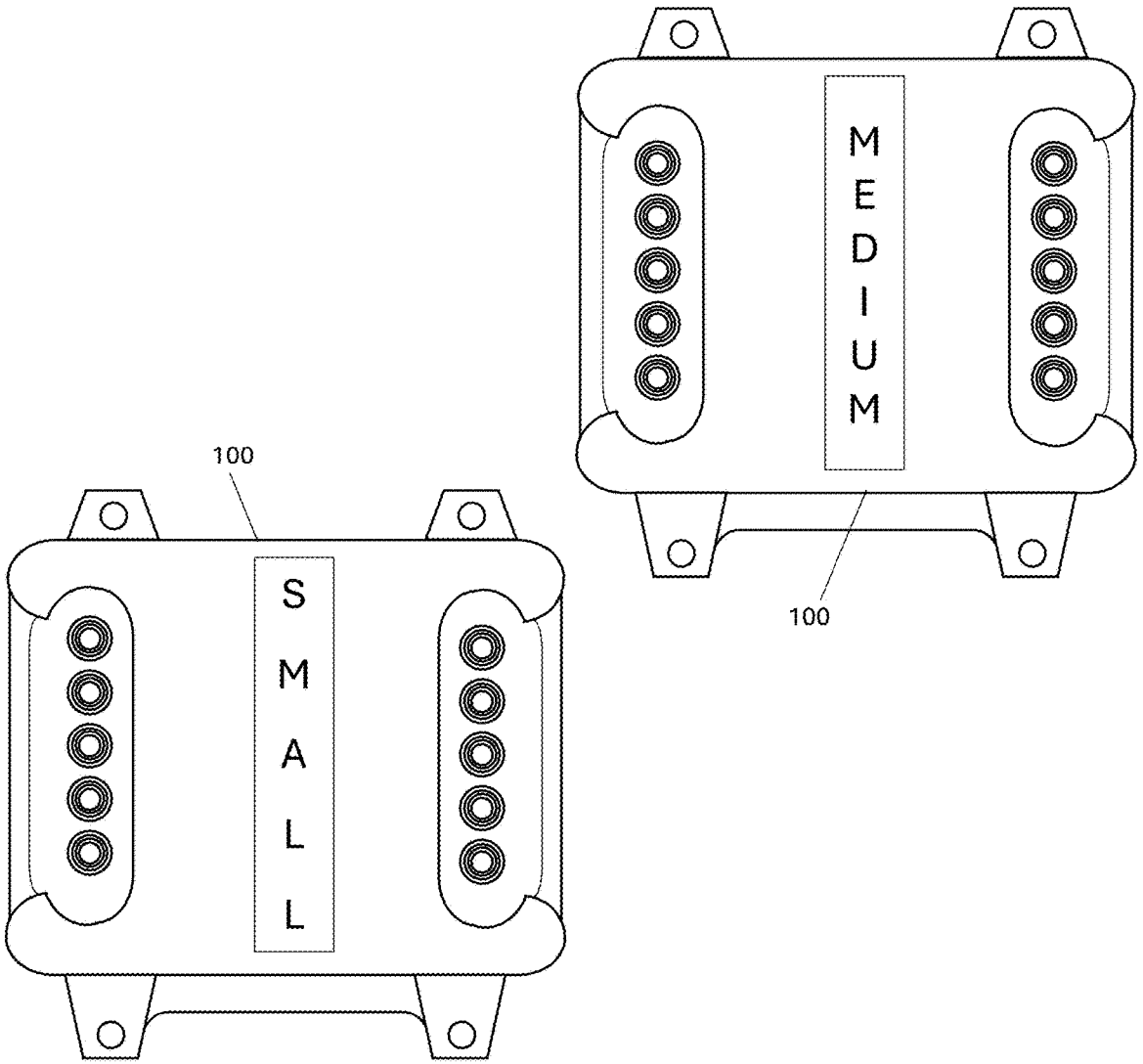
FIG. 3 shows a front view of two glove dispensers (100) for different sized gloves mounted on a wall together. Loaded glove packets are not shown.
Figure 4:
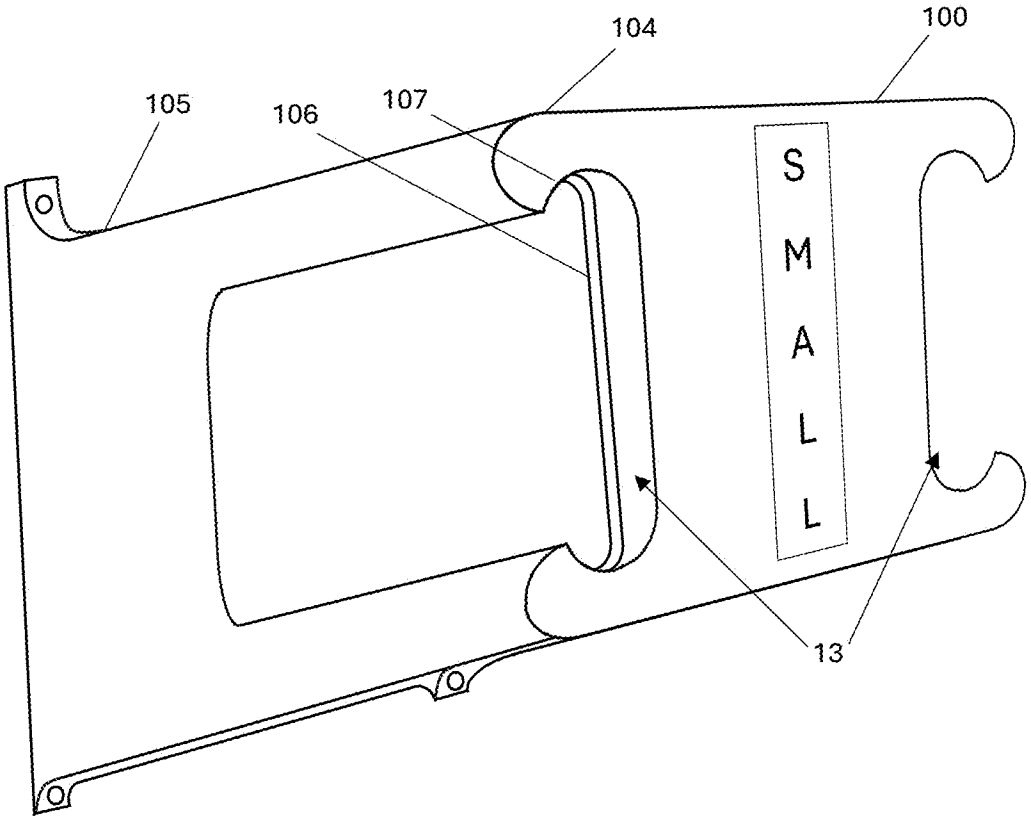
FIG. 4 shows a ¾ profile view of a dispenser (100) as it could be mounted on the wall. This view shows a dispenser before glove packets are presented at the gloving area.

In a preferred form of the invention shown schematically in FIGS. 2-4, the glove dispensing and donning device (100) is mounted against a vertical surface, such as a wall or side of a cabinet. In other embodiments, the device may be mounted atop a cart or other mobile support. In another embodiment, the housing may be extended in size to allow for a larger storage area to store a larger number of glove packets. In another embodiment, the housing may be built into a wall of a building or vehicle console or vehicle door panel such that the exterior of the housing is flush with the said wall, console, or door panel.

FIG. 2 is a front view of the glove dispenser (100) with glove packets (200) already loaded into gloving position. In a preferred form of the invention, the device is of compact size, approximately, but not limited to, the size of a wall-mounted paper towel dispenser. In a preferred form of the invention, each device is the same size while the cartridge can be sized for a particular glove size and the loading space can be sized or adjusted accordingly. The example in FIG. 2 has labeling that shows it holds small sized gloves. FIG. 2 shows a glove packet (200) dispensed and presented to the gloving area with the periphery of the packet held within a C shaped housing (107) of the right hand gloving area. Within the housing are one or more clamps that keep the glove in place for gloving. Five large dots on the presented glove packet exterior indicate the place where the user presses the tips of his fingers to begin the hand gloving action when the gloves are loaded as in FIG. 2.

FIGS. 2-4 show a preferred form of the invention where there are two gloving areas, one for the left hand and one for the right hand. In another embodiment, there may be only one gloving area, to be used for either hand.

The user guides his hands forward, approximately aligning fingers with the finger holes of the prepared glove. The user pushes his hands into the glove packet, with finger tips aligned with the glove fingers, and keeps pushing until the packaging material tears away and the fingers are inserted into the corresponding glove fingers. Once the hands are fully gloved, the user pulls them away from the sides of the dispenser and the packaging material is removed from the gloving area into an internal or external disposal area (not shown).

FIG. 3 shows the front view of two glove dispensers mounted on a wall, containing different sizes of gloves. A third dispenser, holding size Large gloves, could be mounted in the same fashion one step up and to the right of the Medium size. Typical medical glove situations provide for Small, Medium, and Large sized gloves. This invention of gloving dispensers could dispense three sizes of gloves, Small, Medium, and Large, or dispense two sizes, S/M, and M/L utilizing only two gloving dispensers. In such an embodiment, two or three identical dispensers may be utilized, each holding a different size of glove, and a window, label, or other demarcation may be used to indicate the size of the gloves being dispensed. Gloving dispensers are stacked in a staggered formation so as to allow for the cartridge (300 shown in FIG. 1 and FIG. 9) of glove packets to be loaded at the top and already gloved hands to exit the sides of each dispenser. Each dispenser may be mounted at an approximate hip height appropriate for small, medium, and large height users. For instance, if your hips standing are approximately the height of the Small dispenser, you are probably a size Small glove. This is not a rigid measurement as anyone can access any dispenser, just a guideline for wall mounting. Each dispenser is staggered above the other in a staggered-stacked formation, the lowest one containing the Small gloves. Dispensers could be mounted in different places in a room, as well, but if stacked, the dispenser with Small size gloves should be the lowest mounted.

FIG. 4 shows a ¾ profile view of the dispenser as it would be mounted on the wall. This view shows a dispenser before glove packets are mechanically maneuvered into the position ready for gloving. In this example, the dispenser is angled slightly downward from the front (104) to the back (105) so that the user's hands will follow a slightly downward trajectory when pushing forward into the glove packet. This shows how some embodiments could allow for ergonomically efficient comfort of gloving. Other embodiments could have dispensers that are completely horizontal or angled up from front to back if preferred by customer. All such variants are considered within the scope of the invention.

Also shown in FIG. 4 is a slit (106) near the front of the dispenser, through which a single glove packet is delivered to the gloving area for presentation to the user's hand. In the preferred embodiment, two glove packets are delivered simultaneously to left and right hand gloving areas, one packet for the left hand and one packet for the right hand. The mechanism for handling the packet is internal to the dispenser and is not shown. In the preferred embodiment, a sensor sensing the presence of the user's hand over a sensing region, initiates a motor operated mechanism that engages mechanical linkages to push one glove packet from the storage area out into the gloving area, In another embodiment, a lever can be manually operated to engage said mechanical linkages. Once the glove packet is moved out of the storage area into the gloving area, the packet is secured along the edges via a clamping mechanism (not shown). In the preferred embodiment of the invention, this clamping action may be accomplished by the initial motor operated mechanism. In another embodiment, a separate actuation may be used to activate the clamping mechanism. This actuation may be manually or mechanically operated or accomplished via an electric motor or pneumatic means.

Figure 5:
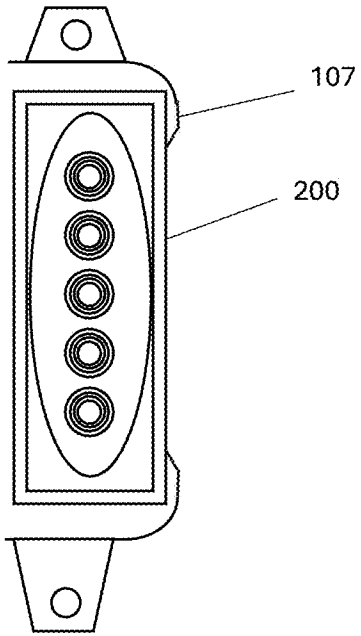
FIG. 5 shows a cutaway view of the right side gloving area with glove packet (200) in gloving position. The "C" shaped housing (107) conceals a set of clamps that hold the packet stationary during gloving.

FIG. 5 shows a cutaway of the housing to show the front view of a dispensed and presented glove packet (200) with the periphery of the packet held within a C shaped housing (107) of the right hand gloving area. In the preferred embodiment, visual finger guides assure that the correct fingers are guided into the correct holes. In one embodiment of the invention, a mechanical or visual guide, may be used to place the fingers at the correct locations for insertion into the corresponding finger holes of the glove.

Figure 6:
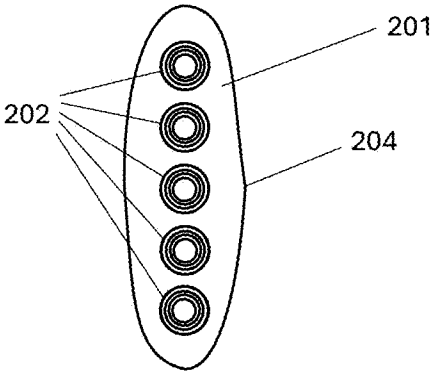
FIG. 6 is a detailed view of a prepared glove (201), showing each glove finger (202) compressed in a concentrically telescoped pattern. This facilitates the donning of the glove by the user. This invention has different embodiments of compressing the gloves for donning, such as folding, etc. All such variants are considered within the scope of the invention. For the purposes of explanation in this drawing, the concentrically telescoped glove variant is depicted.

FIG. 6 is a detailed view of a prepared glove (201). Each finger (202) is compressed in a concentrically telescoped pattern which flattens each glove finger into its opening. This facilitates the donning of the glove by making the finger openings visible and directly accessible by the user's fingertips without manipulation. Other folding, rolling, or other methods of preparing the glove fingers may be used. The glove's wrist cuff (204) is held open to ensure no obstruction of the finger openings. In one embodiment of the invention, the wrist cuff may be reinforced by a frame made of thin material, such as cardboard, to provide a sturdy substrate for the gloving clamps, as well as to hold the glove in place during gloving. In another embodiment, the packaging material may be sufficiently sturdy that the clamps may press directly onto it, and other methods, such as vacuum sealing or removable adhesives may be used to maintain glove position and orientation. In another embodiment, wide, blunt hooks or other holding mechanisms can be employed to hold temporarily the cuff securely open for donning by the user.

All variants of glove preparation and glove frames are considered within the scope of the invention. The main requirement is that the rim of the glove remains in place for gloving. Once the user's hands enter the gloves and continue pushing into the gloves, the gloves unroll or unfold to cover fingers and hands as the hands continue forward. The glove frame and packaging material are then released from the clamps and discarded after gloving.

Figure 7:
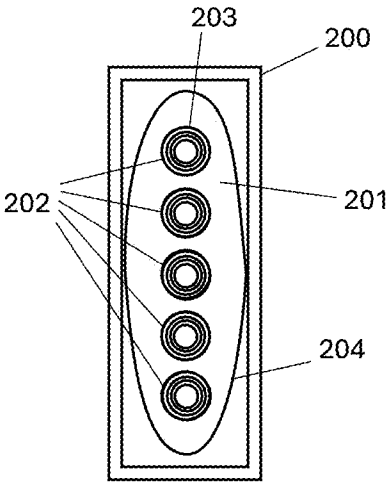
FIG. 7 shows a front view of a single packet (200) containing one prepared glove (201). In an embodiment of the invention, each glove finger (202) has been concentrically telescoped and oriented with the thumb (203) at the top. The glove cuff (204) has been stretched open to expose the folded fingers. The entire glove is immobilized in a predetermined position to facilitate reliable donning of the glove when presented at the gloving area.

FIG. 7 is a front view of a single glove packet (200), where the glove has been prepared in the manner shown in FIG. 6. The packaging is made of extremely thin material that tears away easily with little pressure during the gloving process. In the preferred embodiment of the invention, multiple packets would be held vertically in a cartridge (see FIG. 9) ready to load into the glove dispenser, similarly to the way staples load into a stapler. The enclosed glove may be either a fitted glove, which is designed specifically for a left hand or specifically for a right hand, or an ambidextrous glove, which can fit either a left or right hand. The glove may be any disposable glove including but not limited to an examination glove or a surgical glove. In another embodiment of this invention, the glove packets are connected one to another, with perforations in between each packet and rolled up as in a paper towel roll. The roll of glove packets is placed into and held in the storage area. Dispensing of an individual glove into the gloving area is achieved by a mechanism pulling on the outermost glove packet, and separating it from the remaining packets in the roll. In yet another embodiment, the connected glove packets may be accordion-folded into a stack. The front end of the stack sits on a barrier with a slit. The forward-most glove packet is fed through the slit. Dispensing of a single glove is then achieved by a mechanism pulling on the forward-most glove packet and separating it from the remaining packets in the stack. All variants of using various ways of packaging the gloves for dispensing and holding gloves at the ready are considered within the scope of the invention.

Various elements may be added to the embodiment shown in FIG. 7 to facilitate or enable mechanisms for transporting packets from the storage area to the gloving area. As an example, the outer rim may be made of rigid or semi-rigid material. Rings, tabs, or hooks may be attached to facilitate grabbing by the dispensing mechanism. Spacers may be used to provide accurate spacing between adjacent packets that may increase reliability of the transporting mechanism.

In addition, various elements may be utilized to ensure a reliable gloving process. As an example, the orientation and position of the prepared gloves (201) within their packets may be maintained by the use of weak, temporary, or removable adhesives that immobilize the glove cuff or other areas of the glove. Perforations may be made in the packet material to facilitate penetration by the user's fingers. The glove cuff (204) may be mounted onto a frame that may serve as the surface engaged by the gloving clamp as well as provide rigidity for transportation from storage area to gloving area.

Figure 8:
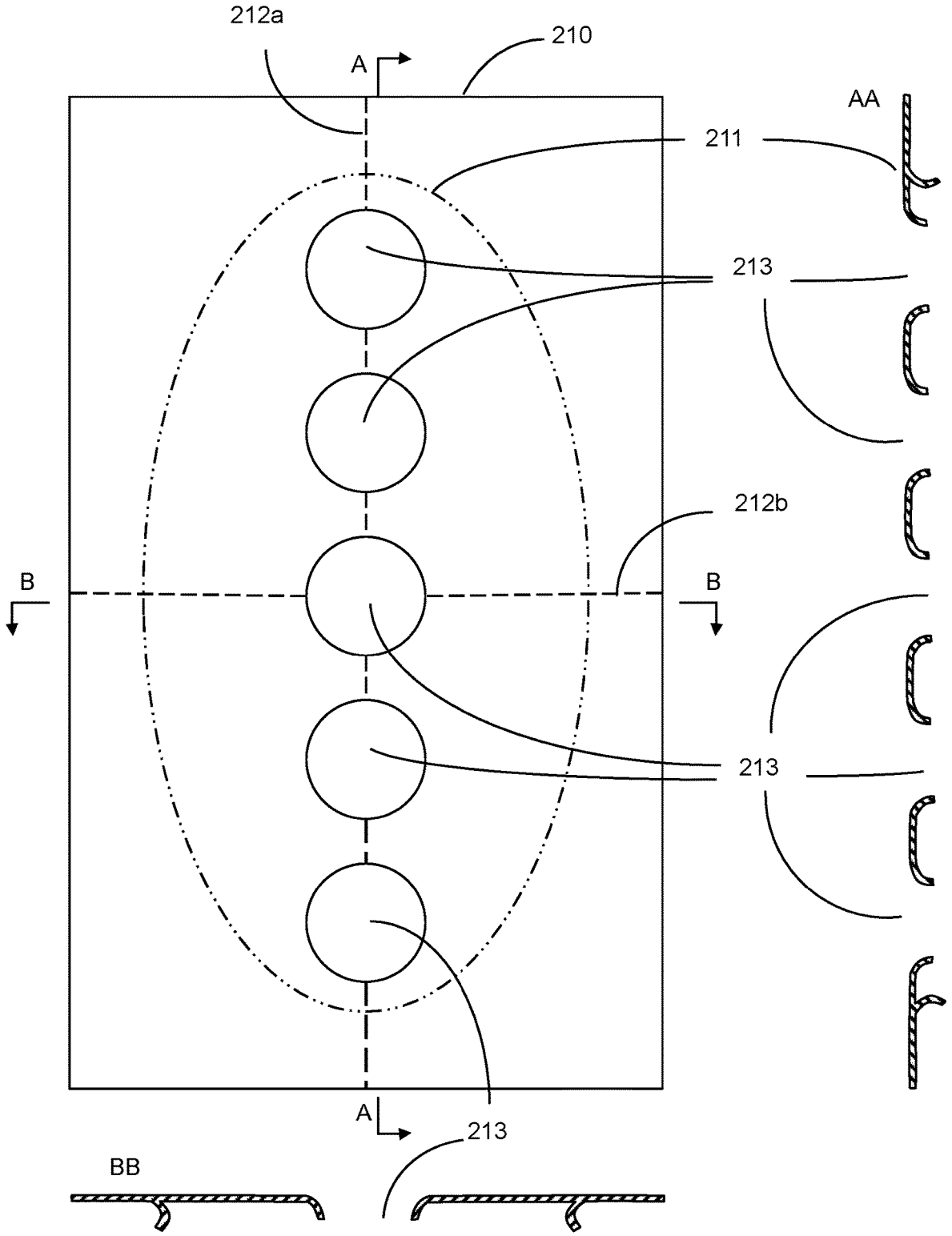
FIG. 8 is a general representation of a frame (210) that may be used to maintain position and orientation of a single glove within a packet, as well as to provide a surface for clamping onto.

FIG. 8 is an example of such a frame (210) that may be used to maintain position and orientation of a single glove within a packet, as well as to provide a surface for clamping onto. This frame is contained within a glove packet. An oval ridge (211) on the underside of the frame (210) holds open the glove cuff within the packet as well as during donning of the glove by the user. Perforations (212*a* and 212*b*) in the frame allow the frame to break apart during the donning process. Holes in the frame (213) guide the user's fingers to the glove fingers. Section AA of FIG. 8 shows a cross section of the frame when viewed from the long edge and Section BB of FIG. 8 shows a similar cross section when viewed from the short edge of the frame.

Once the glove packet is in the gloving area, the user begins pushing his or her fingers and hands into the packet (200). The packaging material tears away exposing the glove held in place. Once the user has pushed his hands all the way into the glove, the user pulls his hands sideways out of the dispenser, fully gloved.

In one embodiment of the invention, the sensing of the fully gloved hand may trigger a release of the clamps holding the glove packet, allowing the residual packaging material to fall into or be removed into an internal or external disposal area.

Figure 9:
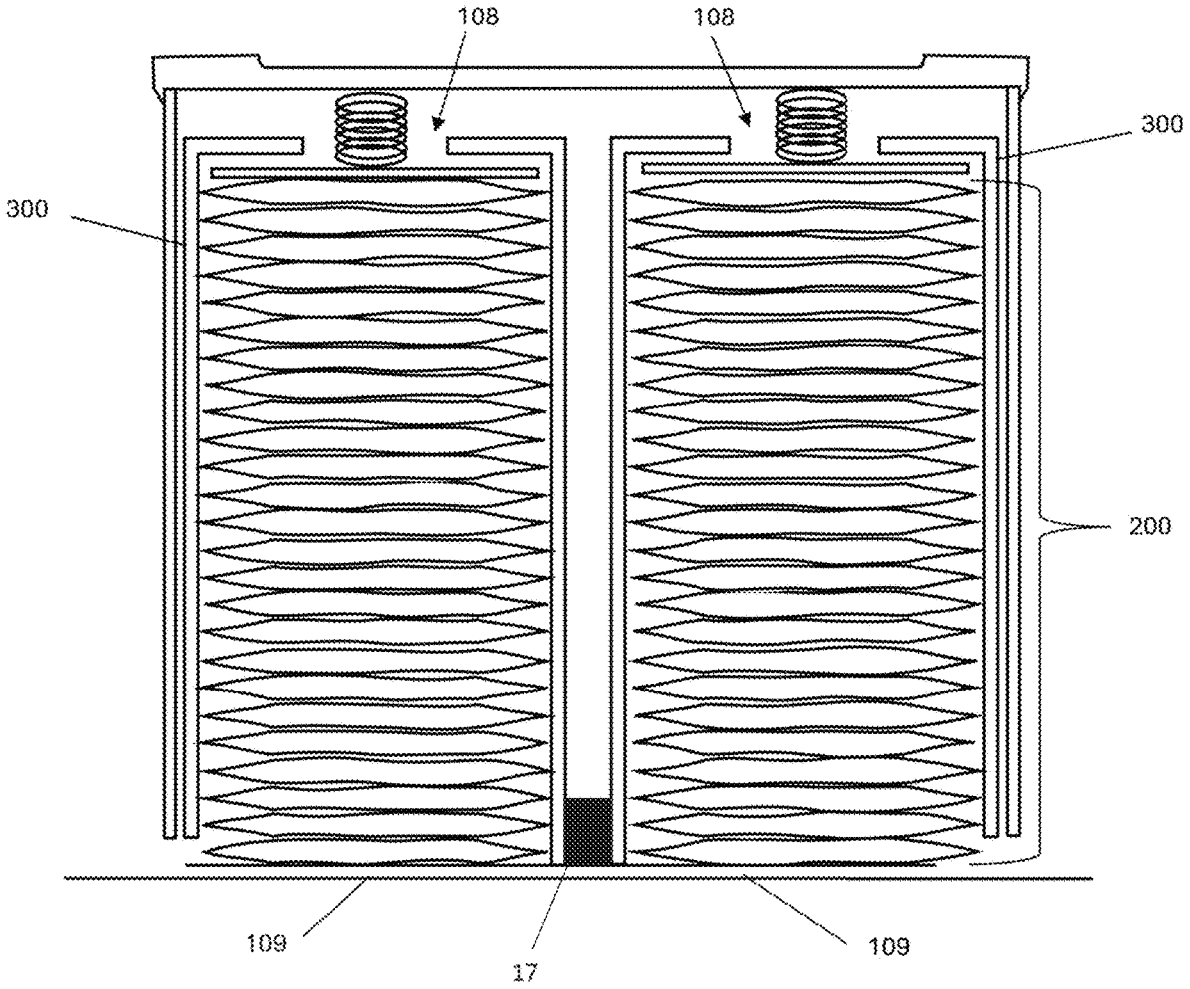
FIG. 9 is an overhead, cut-away view of a spring-loaded embodiment of the dispenser showing the top of glove packets in a cartridge (300) loaded into the storage area of the dispenser. Near the front left and right sides of the dispenser are openings through which single glove packets are transported from this storage area to the gloving area. This invention has various embodiments with different loading mechanisms such as springs, motor, pneumatics, etc. All such variants are considered within the scope of the invention. For the purposes of explanation in this drawing, the spring-loaded variant is depicted.

FIG. 9 illustrates one embodiment of the invention in an overhead, cut-away view of the storage area 12 enclosed by the housing 11 of the dispenser. A spring-loaded mechanism (108) at the back of the dispenser pushes against the glove packets (200) in a cartridge (300) that has been loaded into the storage area 12. This mechanism moves the glove packets (200) forward as each packet is transported to the gloving area. In other embodiments of this invention, different loading mechanisms such as, but not limited to, spring, motor, or pneumatic, etc. can be utilized. All such variants are considered within the scope of the invention. For the purposes of just this drawing, the spring-loaded variant is depicted. In another embodiment of the invention, the storage area 12 may be in a separate housing from that of the gloving area. In that embodiment, the user may manually take one glove packet from the storage area 12, place it into the gloving area, clamp it, and then proceed with gloving.

Each cartridge holds multiple glove packets. The cartridge of glove packets is loaded into the storage area of the dispenser. The spring-load (or motor or pneumatic trigger considered within the scope of the invention) pushes the packets toward the front section (109) of the dispenser where the glove packets are staged for transporting to the gloving area. One packet from the left cartridge is transported to the left gloving area and one packet from the right cartridge is transported to the right gloving area.

The user engages a mechanism that transports the frontmost glove packets into their respective positions in the gloving area, either individually or synchronously. One of many different methods can be used to achieve this action. In the preferred embodiment of the invention, a sensor triggers the motor-driven mechanism that transports the glove packet from cartridge to gloving area. In another embodiment of the invention, the user may operate a lever to transmit mechanical force, or press a button or other device to operate an electrical motor or pneumatic device. The mechanism may involve components such as linkages, frames, hooks, or pinchers that push or pull a glove packet from the front of the storage area into the gloving area.

Once in the gloving area, the glove packet is held in place by a set of clamps pressing against the rim of the glove packet or against a frame around the glove, or the glove cuff itself, keeping the glove steady. The user pushes his hands fully into the gloves to complete the gloving process. Once gloves have been donned, the user pulls his hands away from the housing, freeing the gloves from the packaging materials. In a preferred embodiment of the invention, a sensor detects the presence of the user's fully gloved hands near the back of the dispenser or other area of the dispenser, indicating that gloving has completed, and initiates the clamping force to be removed which allows the packaging materials to be discarded. Any of a number of methods can be used to remove the clamping force. One embodiment is for the user to push a lever with his forearm or elbow while exiting the gloving area. In yet another embodiment, one or more additional sanitary or disinfection steps may be added to the gloving process whereby UV light or blue light, or chemical compounds or vapors may be deployed to increase the level of sanitation of the gloved hand, during the gloving process or upon exiting the device.

Figure 10:
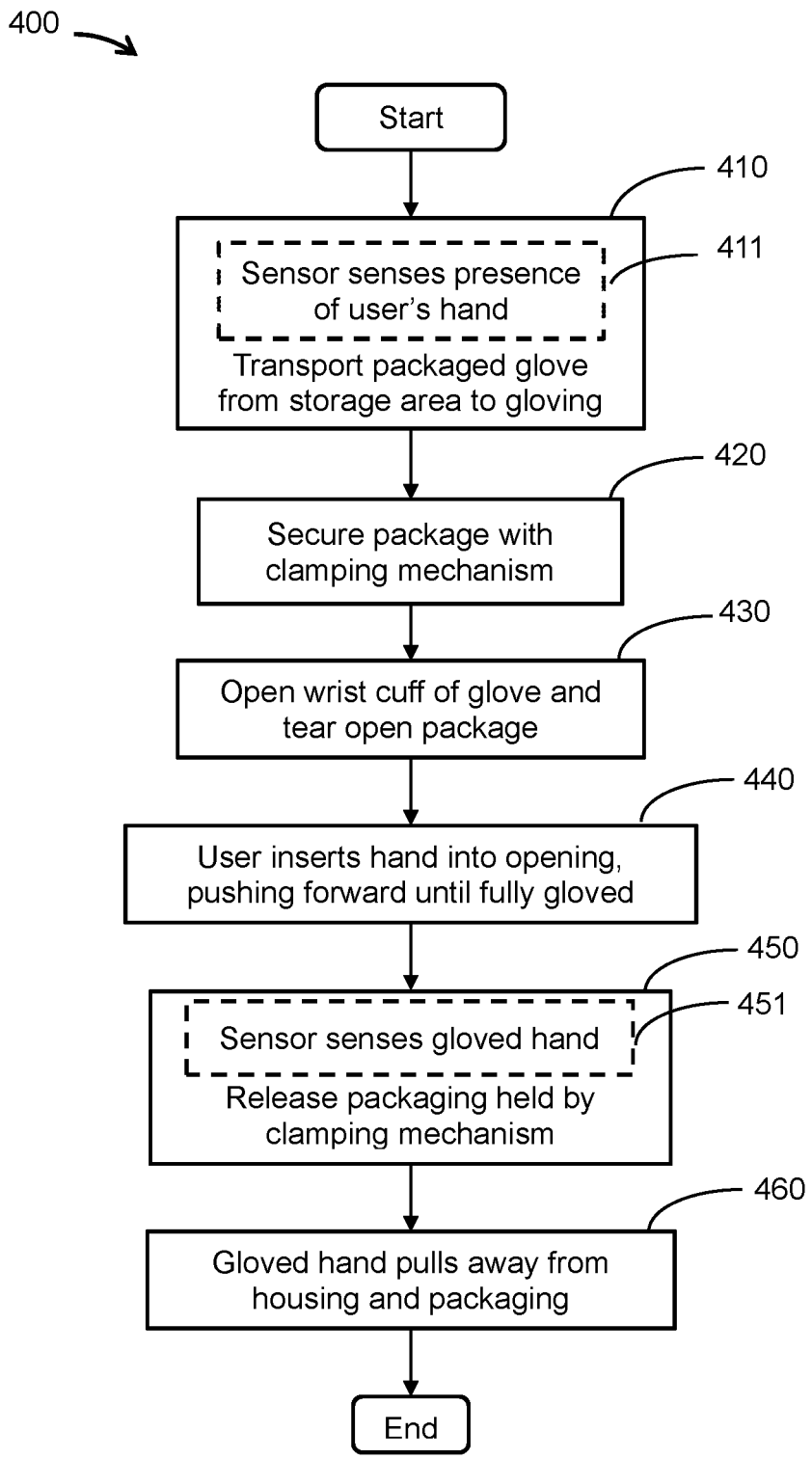
FIG. 10 is a general representation of a method 400 for dispensing and donning gloves.

FIG. 10 is a general representation of a method 400 for dispensing and donning gloves. In step 410, a packaged glove is transported from the storage area to the gloving area. In the preferred embodiment, this step is initiated by step 411, whereby a sensor senses the presence of the user's hand. In step 420, the package that has been transported to the gloving area is secured by means of a clamping mechanism. In one embodiment of the invention, step 430, movement of the clamping mechanism causes the package to tear open and the wrist cuff to open further. In step 440, the user inserts his hand into the glove opening, pushing forward until the hand is fully gloved. In step 450, the packaging is released from the clamping mechanism. In the preferred embodiment, this release is initiated by a sensor sensing the presence of the gloved hand, step 451. In step 460, the gloved hand pulls away from the housing and the packaging.

The claimed invention is:

1. A glove dispensing device, comprising:

a housing having a storage area configured to hold a plurality of individually packaged gloves, wherein each package is a single-glove package that maintains a single glove and comprises a hand insertion portion;

a gloving area; and a motor mechanism configured to transport a single-glove package from the storage area to the gloving area and to engage a periphery of the single-glove package in the gloving area to present a hand insertion portion of the single-glove package to a user with the glove in the package, wherein the gloving area defines at least one side opening configured for left and/or right sideways exit of a gloved hand from the gloving area, wherein the hand insertion portion comprises a set of compressed fingers within the single-glove package at a time of hand insertion, wherein the gloving area includes a first glove area and a second gloving area, wherein the first gloving area and the second gloving area are side by side, and spaced apart by at least a portion of the storage area of the housing, wherein the first gloving area is oriented for left hand gloving and the second gloving area is oriented for right hand gloving, and wherein the first gloving area and the second gloving area each define a C-shaped opening at opposite sides of the housing, each C-shaped opening extending partially into an exterior face of the housing for sideways exit of a gloved hand from the gloving area.

2. The device of claim 1, further comprising:

at least one sensor configured to detect presence of a hand to actuate the motor mechanism to transport the single-glove package from the storage area to the gloving area.

3. The device of claim 1, wherein the single-glove package includes a tear-away material and the motor mechanism is configured to hold the single-glove package until the gloved hand is separated from the tear-away material.

4. The device of claim 3, wherein, in response to the gloved hand separating from the tear-away material, the single-glove package is automatically transferred from the gloving area.

5. The device of claim 3, further comprising:

at least one sensor configured to detect exit of the gloved hand from the gloving area to cause the motor mechanism to release the single-glove package.

6. The device of claim 1, wherein a front of the housing and a back of the housing are parallel to one another and the single-glove package is oriented by the motor mechanism at or near the front of the housing.

7. The device of claim 1, wherein the gloving area is angled downwardly from a front of the housing to a back of the housing and the single-glove package is oriented by the motor mechanism at or near the front of the housing.

8. The device of claim 1, wherein:

the housing includes a front and a back and a slit is formed near the front, and the motor mechanism is configured to deliver the single-glove package through the slit to the gloving area.

9. The device of claim 1, wherein the gloving area is configured as a channel that fits a gloved hand.

10. The device of claim 1, wherein the device further comprises:

a spring mechanism configured to transport the single-glove package from the storage area to the motor mechanism; and wherein the motor mechanism is configured to secure the single-glove package and orient the single-glove package in the gloving area to present the hand insertion portion to the user.

11. A glove dispensing device, comprising:

a housing having a storage area configured to hold a plurality of individually packaged gloves, wherein each package is a single-glove package that maintains a single glove and comprises a hand insertion portion;

a gloving area configured as a channel that fits a gloved hand;

a spring mechanism configured to transport a single-glove package from the storage area to a motor mechanism; and wherein the motor mechanism is configured to engage a periphery of the single-glove package in the gloving area to present the hand insertion portion of the single-glove package to a user with the glove in the package, wherein the gloving area defines at least one side opening configured for left and/or right sideways exit of a gloved hand from the gloving area, wherein the hand insertion portion comprises a set of compressed fingers within the single-glove package at a time of hand insertion, wherein the gloving area includes a first gloving area and a second gloving area, wherein the first gloving area and the second gloving area are side by side, and spaced apart by at least a portion of the storage area of the housing, wherein the first gloving area is oriented for left hand gloving and the second gloving area is oriented for right hand gloving, and wherein the first gloving area and the second gloving area each define a C-shaped opening at opposite sides of the housing, each C-shaped opening extending partially into an exterior face of the housing for sideways exit of a gloved hand from the gloving area.

12. The device of claim 11, wherein:

the housing includes a front and a back and a slit is formed near the front, and the motor mechanism is configured to deliver the single-glove package through the slit to the gloving area.

13. The device of claim 11, wherein a front of the housing and a back of the housing are parallel to one another and the single-glove package is oriented by the motor mechanism at or near the front of the housing.

14. A glove dispensing device, comprising:

a housing having a storage area configured to hold a plurality of individually packaged gloves, wherein each package is a single-glove package that maintains a single glove and comprises a hand insertion portion; and a C-shaped portion of the housing including a gloving area configured as a channel that fits a gloved hand, wherein the gloving area defines at least one side opening configured for left and/or right sideways exit of a gloved hand from the gloving area;

a front, a back, and a slit formed near the front; and a motor mechanism configured to transport a single-glove package from the storage area to the gloving area through the slit and to engage a periphery of the single-glove package in the gloving area to present the single-glove package for hand insertion, wherein the hand insertion portion comprises a set of compressed fingers within the single-glove package at a time of hand insertion, wherein the gloving area includes a first gloving area and a second gloving area, wherein the first gloving area and the second gloving area are side by side, and spaced apart by at least a portion of the storage area of the housing, and wherein the first gloving area is oriented for left hand gloving and the second gloving area is oriented for right hand gloving, and wherein the first gloving area and the second gloving area each define a C-shaped opening at opposite sides of the housing, each C-shaped opening extending partially into an exterior face of the housing for sideways exit of a gloved hand from the gloving area.

15. The device of claim 14, wherein a front of the housing and a back of the housing are parallel to one another and the single-glove package is oriented by the motor mechanism at or near the front of the housing.

* * * * *